United States Patent [19]

Esztergar

[11] 4,395,309

[45] Jul. 26, 1983

[54] FRACTIONAL DISTILLATION OF HYDROCARBONS FROM COAL

[76] Inventor: Ernest P. Esztergar, 6308 Avenida Cresta, La Jolla, Calif. 92037

[21] Appl. No.: 203,255

[22] Filed: Nov. 3, 1980

[51] Int. Cl.[3] ..... C10B 49/06; C10B 49/18; C10B 57/02

[52] U.S. Cl. ..... 201/22; 201/26; 201/28; 201/29; 201/32; 202/117

[58] Field of Search ..... 202/117; 201/10, 13, 201/14, 21, 22, 26, 28, 29, 32; 208/8 R

[56] References Cited

U.S. PATENT DOCUMENTS

| | | | |
|---|---|---|---|
| 1,814,463 | 7/1931 | Trent . | |
| 1,978,945 | 10/1934 | Hereng . | |
| 2,406,810 | 9/1946 | Day | 208/8 R |
| 2,752,292 | 6/1956 | Scott, Jr. . | |
| 2,809,154 | 10/1957 | Storrs . | |
| 3,020,209 | 2/1962 | Culbertson, Jr. et al. . | |
| 3,284,915 | 11/1966 | Berg . | |
| 3,325,395 | 6/1967 | Ban . | |
| 3,361,644 | 1/1968 | Deering . | |
| 3,432,397 | 3/1969 | Berg . | |
| 3,441,480 | 4/1969 | Ban . | |
| 3,475,279 | 10/1969 | Bowman . | |
| 3,483,115 | 12/1969 | Haddad et al. . | |
| 3,560,368 | 2/1971 | Rowland et al. . | |
| 3,560,369 | 2/1971 | Rowland et al. | 196/123 |
| 3,594,286 | 7/1971 | Kemmerer, Jr. . | |
| 3,612,497 | 10/1971 | Allred . | |
| 3,945,890 | 3/1976 | Kemp . | |
| 3,985,637 | 10/1976 | Storrs . | |
| 4,052,265 | 10/1977 | Kemp . | |
| 4,052,293 | 10/1977 | Mercer et al. . | |
| 4,058,905 | 11/1977 | Knight . | |
| 4,082,645 | 4/1978 | Knight et al. . | |
| 4,141,793 | 2/1979 | Aoki et al. . | |
| 4,149,939 | 4/1979 | Solano . | |
| 4,162,943 | 7/1979 | Green et al. | 208/8 R |
| 4,196,051 | 4/1980 | Haley et al. . | |
| 4,200,517 | 4/1980 | Chalmers et al. . | |

FOREIGN PATENT DOCUMENTS

| | | | |
|---|---|---|---|
| 722934 | 9/1977 | U.S.S.R. | 196/123 |

*Primary Examiner*—Bradley Garris
*Attorney, Agent, or Firm*—Hubbard & Stetina

[57] ABSTRACT

Process and apparatus for recovering volatile distillates from coal, and other solid carbonaceous fuel sources, by heating the top surface of a bilayer of coal formed of an upper layer of recycled coal and a lower layer of green coal, maintaining the lower level of green coal at a temperature cool enough to condense constituents distilled from the upper layer of recycle coal, and recycling the once passed green coal as recycle coal is disclosed.

16 Claims, 13 Drawing Figures

Fig. 5
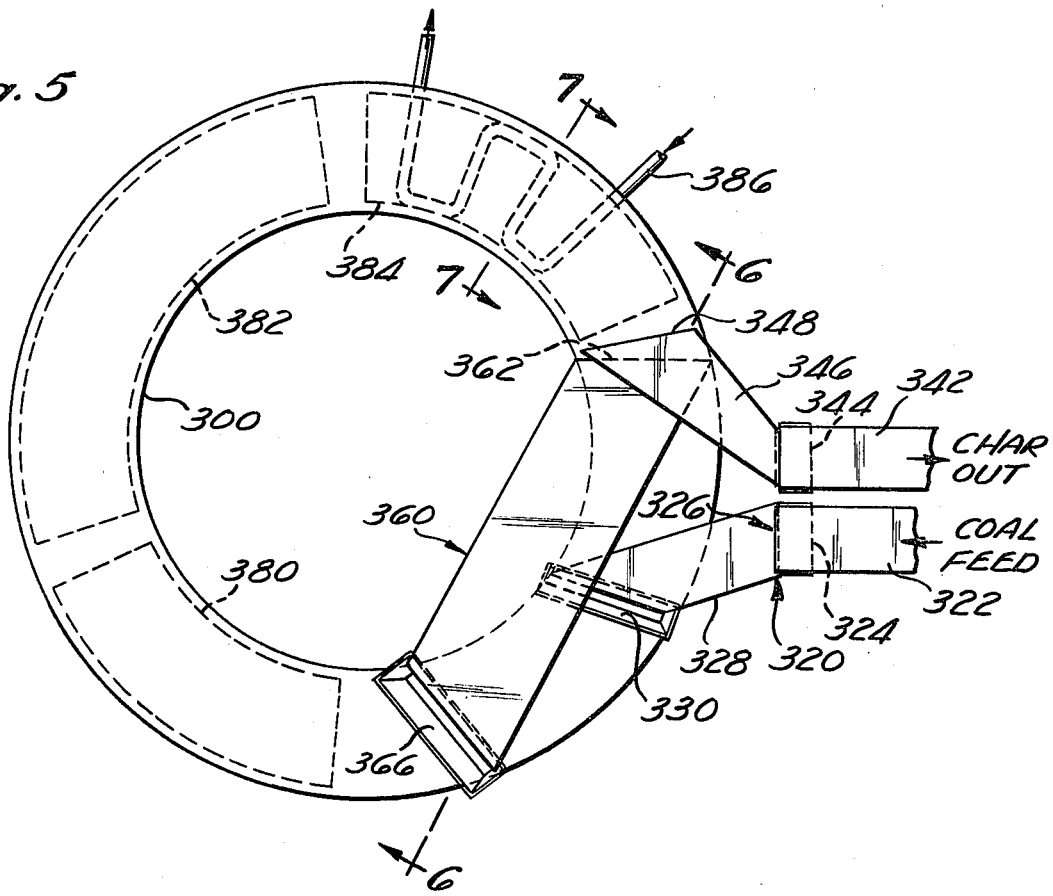
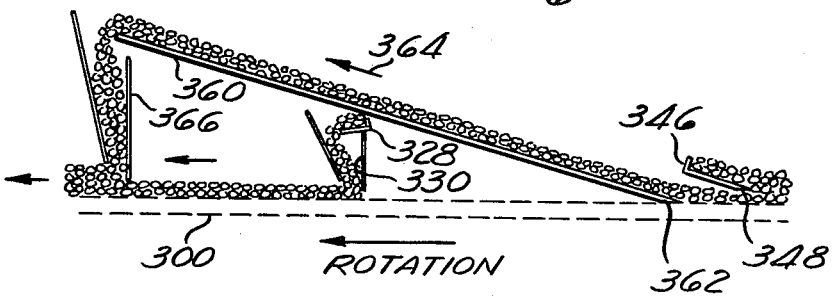
Fig. 6
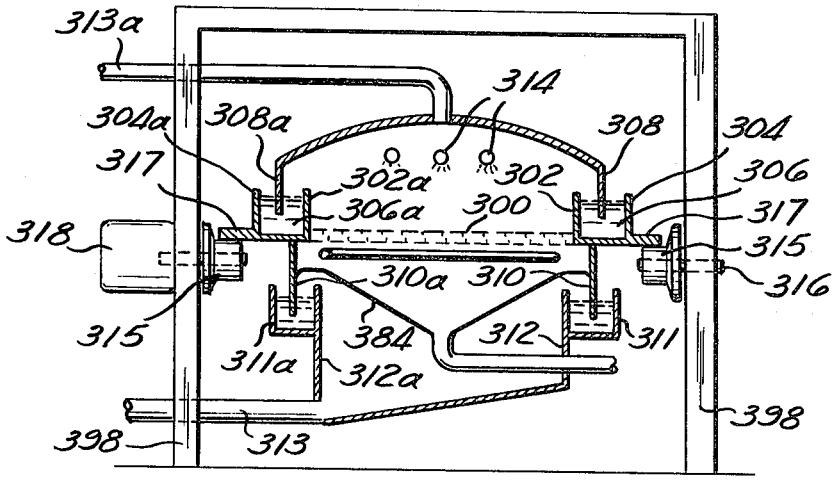
Fig. 7

Fig. 12
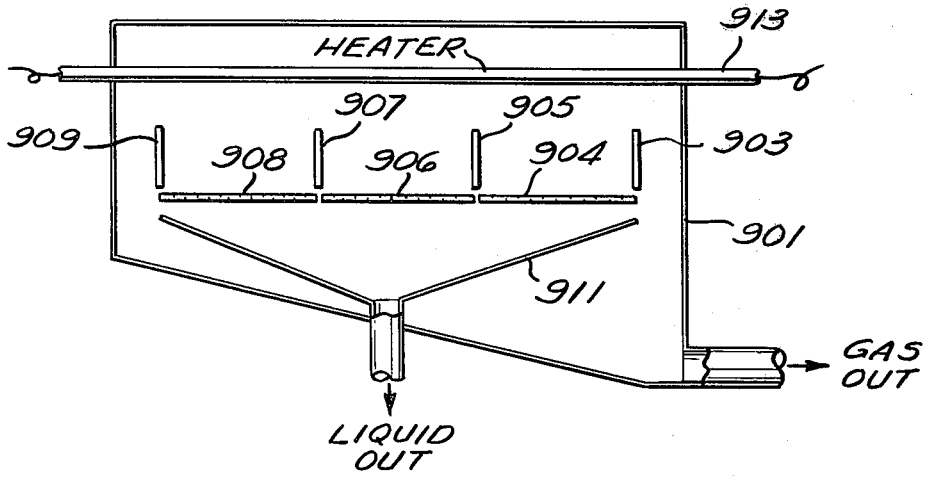
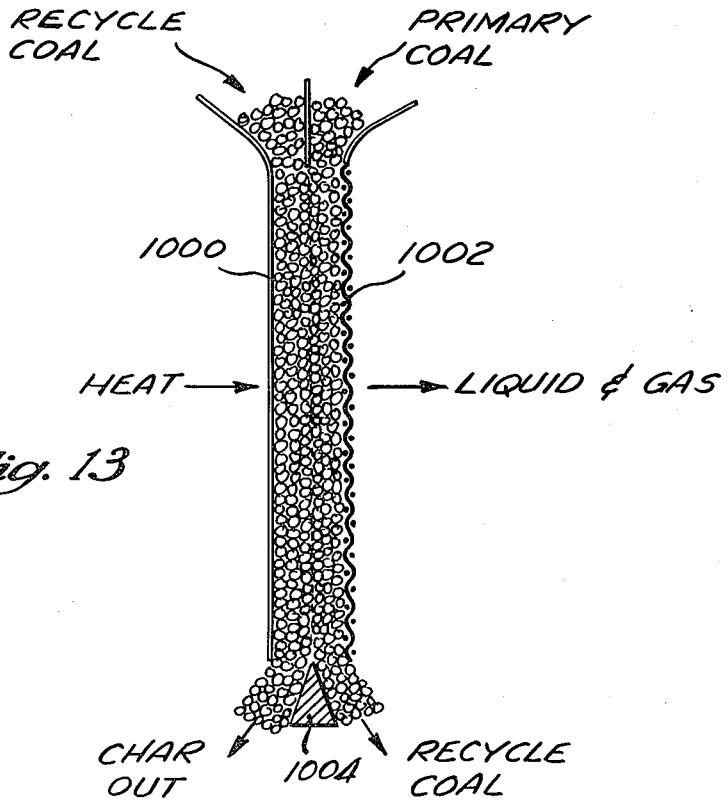
Fig. 13

FRACTIONAL DISTILLATION OF HYDROCARBONS FROM COAL

TECHNICAL FIELD

This invention relates generally to coal conversion technology and, more specifically, to distillation of constituents of coal and recovery of such constituents as liquid oil materials.

BACKGROUND OF THE INVENTION

There has been a continuing interest in the conversion of coal to useful liquid fuels for a great many years. One of the earliest fuels, coal oil, was derived by heating of coal to distil volatile hydrocarbons therefrom. With the development of large scale petroleum resources, interest in coal as a source of liquid fuels diminished for many years. There was renewed interest in coal as the source of liquid fuels for motor vehicle and engine operation in Germany with the shortages in petroleum supplies during the years of World War II, and much of the present technology in this field has its roots in developments during this period in Germany. The last decade has brought a greatly increased interest in apparatus and methods for recovering fuel from coal. Richardson, OIL FROM COAL, Noyes Data Corporation, Park Ridge, N.J., 1975, Chemical Technology Review No. 53, described and summarized the patents and literature and this technology generally as it existed at that date. Perrini, OIL FROM SHALE AND TAR SANDS, Noyes Data Corporation, Park Ridge, N.J., Chemical Technology Review No. 51, provides a similar survey of the technology for recovering oil from the two other major solid carbonaceous fuel sources, shale and tar sands. Howard-Smith and Werner, COAL CONVERSION TECHNOLOGY, Noyes Data Corporation, Park Ridge, N.J., 1976, Chemical Technology Review No. 66, surveyed the major processes and apparatus available for converting coal into other forms of fuel.

The conversion of coal to synthetic oil is described in Kirk-Othmer, ENCYCLOPEDIA OF CHEMICAL TECHNOLOGY, Second Edition, Supplement Volume, Pages 178–198 and the technology of coal generally is described in Kirk-Othmer, ENCYCLOPEDIA OF CHEMICAL TECHNOLOGY, Second Edition, Volume 5.

Storrs, U.S. Pat. No. 2,809,154, Oct. 8, 1957, describes apparatus and methods for treating coal to recover composition products therefrom by heating the coal in a substantially oxygen free atmosphere to release liquid decomposition products from the coal, maintaining the temperature such as to retain the liquid products in their phase, and prevent them from congealing or vaporizing. The coal, in the Storrs process, is formed into a continuous stream, passed through an elongate heating zone and substantially uniform heating of the particles throughout the depth of the bed, the liquid being extracted by withdrawing it from the bottom, through foraminous support member.

Bowman U.S. Pat. No. 3,475,279, Oct. 28, 1969, discloses apparatus and the methods for removing constituents from coal by forming a long horizontal bed of the coal, maintaining a slightly lower pressure at the bottom of the bed, enclosing the bed in a substantially oxygen free atmosphere, radiantly heating the top of the bed while maintaining the bottom of the bed cool enough to condense volatile materials distilled from the top of the bed.

Berg, working with the aforementioned Bowman apparatus and process, devised a modification thereof in which a flow of relatively low temperature gas was caused to flow through the bed to augment radiant heat transfer through the bed, U.S. Pat. No. 3,432,397, Mar. 11, 1969.

Bann U.S. Pat. No. 3,325,395, June 13, 1967, discloses a traveling grate method for recovering oil from shale in which a hearth layer of catalytic material, which promotes cracking of the distillate, is first charged on a grate as a hearth layer, the crushed oil bearing shale is then layered on this hearth layer, the combined bed is heated, and then the bed is divided again into the oil bearing shale and the hearth layer.

There have been many, many other apparatus and processes developed for extracting liquid fuel constituents from solid carbonaceous fuel sources, most of them uniquely applicable to coal, and some having broader application encompassing all forms of solid carbonaceous fuel sources. Other patents in this area are listed in the reference list at the close of the specification.

DISCLOSURE OF THE INVENTION

The present invention constitutes an improvement over the Storrs, Bowman and Berg processes previously discussed, and over the other known processes for recovering liquid fuel constituents from coal. According to the present method, volatile distillates are recovered from solid carbonaceous fuel sources by heating a body of the carbonaceous fuel source, in the exemplary embodiment coal, to volatilize and distil the liquid constituents therefrom. The distilled liquid is at least partially condensed to the liquid phase by contact with one portion of the body of solid fuel which is at a lower temperature than that required for distillation, the lower temperature being below the boiling point of the liquids to be recovered, the body comprises two layers, the first layer comprising principally a primary feed of green solid fuel which is maintained at the lower temperature and a layer of solid carbonaceous fuel which has been recycled from a previous cycle of the process, the recycled solid fuel becoming char which is removed as product, the green solid carbonaceous fuel being removed and recycled back into the process. Liquids are removed from the processing area by any conventional means.

In general, the basic steps of the invention comprise forming a coal into a bed, heating one side of the bed to a temperature sufficiently high to release at least some of the constituents of the liquid product while maintaining the other side of the bed at a temperature sufficiently low to condense at least some of the released products of the high temperature side of the bed, collecting the liquid product, the improvement being forming the bed as a bilayer of coal comprising a first layer of green primary coal which has not previously been subjected to treatment in this method, and a second recycle layer of coal which has previously been cycled through the method as the first layer, and heating the second recycle layer of the coal to the high temperature for distillation while maintaining the first layer of green coal at the low temperature for condensation of the distilled products.

In more detail, the process comprises: forming a bed of coal; heating one side of the bed of coal to a temperature at least sufficiently high to volatilize at least a fraction of the coal constituents which have a boiling point between about 400° F. and about 800° F., the temperatures not being critical; maintaining the other side of the bed of coal at a low temperature which is sufficiently low to condense at least a fraction of the volatilized coal constituents to the liquid phase; collecting the liquid coal constituents; separating the bed of coal into char which formed the high temperature side of the bed and recycle coal which formed the low temperature side of the bed; removing the char from the process; returning the recycle coal to the process to form the high temperature side of a new bed of coal and inputting green coal as primary feed to the process to form the low temperature side of the new bed. Preferably, the invention is carried out on a continuous basis by continually forming a bed of coal, as described, removing char, feeding green coal, and, of course, removing liquid product. Preferably, a gas pressure differential is maintained between the two sides of the bed, the high temperature side of the bed being maintained at a higher pressure than the low temperature side of the bed, thereby causing the gas to flow from the high temperature side of the bed through the bed to the low temperature side of the bed to carry volatilized constituents of the coal into contact with the low temperature side of the bed for condensing at least some of the volatilized constituents to liquid.

The proccess is carried out in the substantial absence of oxygen, in most commercial instances.

It is desirable to maintain the heating and rate of flow of the coal through the process zone such that approximately one-half of the bed comprises the high temperature side and the other half comprises the low temperature side, this is simply a convenience for the continuous process and not critical to the operation of the process, however.

Radiant heat is the preferred form of heating the high temperature side of the bed. In pilot plant operation, electrically heated Calrods are most conveniently used because of their ease of placement and replacement and total controllability. In large and more permanent installations, for economies inherent in direct combustion, it is often desirable to provide indirect radiant heat by burning coal or liquid fuel, perhaps derived from the coal, in a firebox one wall of which provides radiant heat to the coal. Any form of radiant heat may, however, be used. It is not necessary that radiant heat be used at all, and directly conducted heat may be used but, it is far preferable in the invention to use radiant heat.

An oxygen free atmosphere in the processing zone is most conveniently provided by extracting some of the gas from below the coal bed, treating it for removal of certain desired constituents, hydrogen, hydrocarbons, etc., which have value for further treatment of the coal or for resale, and recycling all or part of the residual gas, which includes a very high proportion of gases which are inert under the conditions of the reaction, namely nitrogen, carbon monoxide, and carbon dioxide. The off gas will typically include hydrogen and low molecular weight, i.e. C-1 to C-4, hydrocarbons.

The absolute temperature of heating the coal and of maintaining the lower side at a cooler temperature, depend upon the coal, or other source of solid carbonaceous fuel, e.g. tar sands, oil shale, and the like, and, more specifically, upon how readily constituents may be volatilized from the solid fuel source and the mix of constituents which are desired. Indeed, one of the great economic advantages of this invention is that by varying the ratio of the temperatures, and the absolute temperatures through the coal bed, the liquid product output can be varied to produce a light oil comprising principally C-6 to C-10 hydrocarbons, saleable as fuel and for chemical processing, e.g. as solvents, or heavier oils, or a combination of the two. Indeed, by tuning the process, the most desirable fraction of the liquid available from the particular source fuel may be optimized. Generally speaking, however, the bottom of the bed will be in the range of 350° more or less to about 600° F. the top of the bed being in the range of from about 550° to about 1,100° F., these being general temperature ranges with no criticality as such. Obviously, optimum temperatures and temperature ranges may be easily arrived at for a given feed and a given desired product by a few simple experiments.

The invention also comprises apparatus for extracting liquid fuel from coal distillate. The apparatus, in general, includes means defining a processing zone, for conveying a bilayer of coal through the processing zone, for forming a layer of green coal on the conveying means and forming a layer of recycle coal on top of the green coal layer, to form the coal bilayer, on the conveying means with one side of the recycle coal layer intimately adjacent one side of the green coal layer. Means for heating the other side of the recycle coal layer and maintaining the other side of the green coal layer at a lower temperature, means for collecting the liquid product from the processing zone, for removing the layer of recycle coal from the processing zone separately from the green coal, and returning the green coal, which has passed through the processing zone once, to the input of the processing zone as the layer of recycle coal for a second pass, and means for feeding the green coal to form a layer of green coal on the conveying means are included in the apparatus.

The apparatus also typically includes means for maintaining a substantially oxygen free atomsphere in the processing zone and for forcing the flow of substantially oxygen free gas through the bed of the coal during heating from the heated side to the unheated side of the bed.

In a more general sense, the apparatus for recovery of liquid fuel constituents from coal by distillation includes enclosure means which define at least one, and in a preferred embodiment at least two processing zones for excluding air therefrom and permitting removal of gas from the processing zone, at least one and, preferably, two or more foraminous conveyors for supporting a bed of coal and transporting said bed without substantial mixing through the respective processing zones, green coal feeder means for forming a layer of green coal on the conveyor or conveyors as a first layer, recycle coal feed means for forming a layer of recycle coal on the first layer of green coal on each conveyor, means for heating the top of the layer of recycle coal in each processing zone without heating the bottom of the green coal layer, means for removing the top layer of recycle coal from the bed on each conveyor separately from the bottom layer of coal thereon, and means for transporting the bottom layer of coal to the recycle coal means for forming a layer of recycle coal either on the same or another conveyor, and means for recovering the liquid distillate from the enclosure.

Again, preferably, means are provided for pressurizing each process zone into an upper pressure zone and a lower pressure zone, respectively, above and below the coal bed, the lower pressure zone being at a pressure lower than the upper pressure zone for causing the gas to flow from the upper zone, on the hot side of the bed, through the bed to the lower zone for carrying the distillate into contact with the cooler bottom portion of the bed for condensing the distillate. Means for removing, processing and recycling gas into the processing zones are also provided.

In the following disclosure, specific apparatus, process steps, processing conditions and operating features are disclosed; however, it is to be clearly understood that these are merely exemplary of the invention and are given to disclose the invention in the best embodiment presently contemplated by the inventor, and do not in any sense constitute a limitation upon the invention. This is particularly so with respect to the apparatus, since many apparatus can be used to carry out the invention, the novel and unique advantages of the particular apparatus being only one of many forms which could be used for carrying out the process.

BRIEF DESCRIPTION OF THE DRAWINGS

FIG. 5 is a top plan schematic view of yet another alternative embodiment of apparatus for carrying out the invention, using an annular revolving disc as the foraminous conveyor.

FIG. 6 is a side view depicting in greater detail, with the addition of coal, the apparatus of FIG. 5, the view of FIG. 6 taken substantially along lines 6—6 in the direction of the arrows in FIG. 5.

FIG. 7 is a vertical, elevational view of a cross-section of an apparatus of the type depicted in FIG. 5, but showing greater structural detail, taken substantially along the arrow shown in FIG. 5 at 7—7.

FIG. 12 is a vertical cross-sectional schematic depiction of an arrangement of the type depicted in FIG. 11, showing the relationship of the conveyors.

FIG. 13 is another embodiment of the invention in which heating is provided by direct conduction to the coal, rather than by radiant heat.

FIG. 1 is a schematic depiction of an apparatus suitable for carrying out the process of this invention. In considering the structure shown in FIG. 1, it must be realized that the structure is schematic only and that details of construction are not given for purposes of clarity. It will also be understood that the constructional details of the apparatus are not part of the invention and that these constructional details are, once the invention is disclosed and explained, well within the skill of the art.

Figure 1:
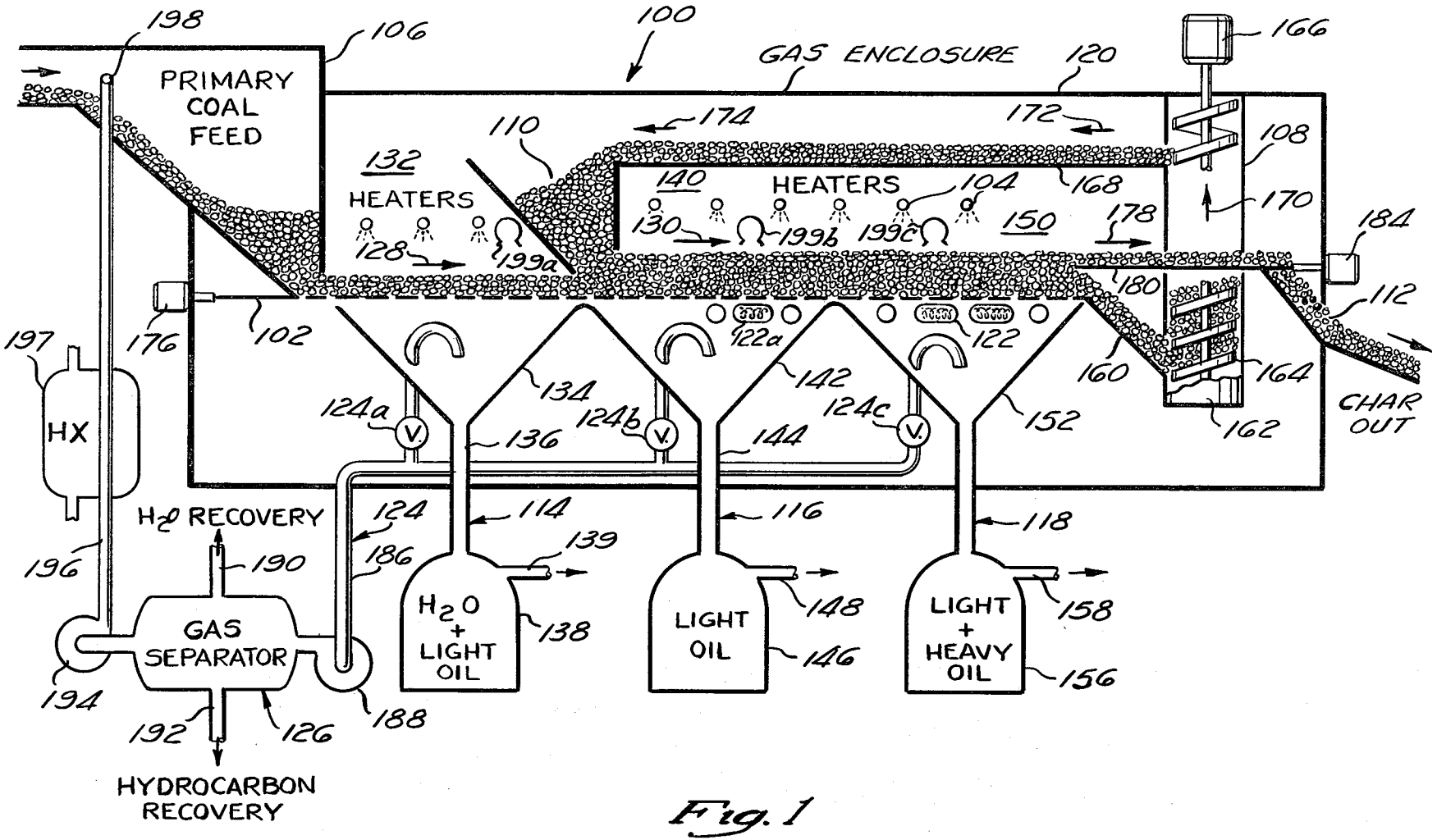
FIG. 1 is a schematic view, taken from the side, showing an apparatus for carrying out the process and for illustrating the operation of the process of this invention.

In a schematic apparatus 100, the principal elements are a foraminous conveying means 102. The conveying means 102 may be of any convenient configuration. For example, a continuous foraminous belt, which will permit liquids to fall through the belt, is a convenient and conventional approach for conveying comminuted materials, such as ground coal. Likewise, a perforated vibratory plate is another recognized and convenient way for conveying particles laterally along a process path. Any other mechanical conveyor for particulate materials may be used. Conveyors suitable for use in this invention are described in the CHEMICAL ENGINEERS' HANDBOOK, 5th Edition, Perry and Chilton, McGraw-Hill Book Company, Chapter 7. In addition, the material handling arts include numerous types of mechanical conveyors for particulate matter which may comprise the foraminous conveying means 102. Various conveyers are disclosed in the references cited herein. The only essential requirements for the conveying means 102 are that it convey the coal along the process path in a more or less consistent physical arrangement, i.e. without excessive mixing vertically through the bed, which will permit one surface to be heated and the other to remain cool or to be cooled, and which will permit liquids to be recovered from the bottom of the conveying means. Normally, the conveying means will be foraminous, i.e. permitting the liquid and gas to pass through. But in particular instances, the conveying means may be narrow enough or tilted, sloped or configured that collection could be accomplished along one side or in a sump portion of the conveying means, for example, all of which would be fully equivalent as a foraminous conveyor.

The next essential element of the apparatus is a suitable heating means, indicated by heaters 104. All of the heaters depicted are shown to represent the conventional and well known Calrod resistance electrical heaters. These Calrod heaters are used as an illustration of heat source because they are well known, easily mounted and controlled, and permit highly efficient use of electric energy for radiant heating. The Calrod heaters are depicted, however, only because they are a convenient source of heat and not because there is anything unique or critical about the use of this type of heater. Indeed, any source of heat which will heat the surface of the coal as it passes through the process zone, including preheated inert gas, may suitably be used. For example, heater tubes carrying heated fluids or gases, or even combustion products, from any source of heat, including heater tubes in which a fuel is injected into the tube and combustion occurs in the tube, or even in the space above the coal, may be used.

Primary coal feed means 106 feeds to one portion of the conveyor a layer of coal. For a given installation and for given process conditions, it is likely that the size of the coal particles may be optimized. Typically, pea size coal is a suitable feed for this process but for the process in general there is no criticality as to the particle size of the coal. Similarly, there is no criticality as to the type or structure of the primary coal feed means. The coal may be conveyed along a conventional continuous conveyor belt, by a skip hoist, by a vibratory conveyor, pneumatically or in any other manner. All that is necessary is that it provide a source of coal into the process zone by feeding it onto the conveying means 102. The coal may even be hand fed.

Another element of the apparatus is a coal recycle means 108 which, in the embodiment depicted, includes a lift for the bottom layer of coal and means for recycling and then returning it to a secondary coal feed means 110 which forms a layer of the recycle coal on top of the layer of primary green coal. The primary green coal is returned through the process a second time partially or completely devolatized as recycle coal and is recovered and taken out as char as indicated at the char removal means 112.

One or more distillate removal means indicated generally at 114, 116 and 118 are also provided.

The entire processing zone is enclosed in a gas enclosure 120. This would include suitable seals or gas flow barriers at the primary coal feed and the char removal points to minimize the inflow of air from the surrounding atmosphere and to minimize the loss of gases from the enclosure into the surrounding atmosphere.

Chilling means 122, which are depicted in the form of a chilling coil to carry any suitable chilling liquid are provided at the distal portion of the processing zone to cool the bottom layer of coal which is being processed. Additional chilling 122*a* may be provided also.

It is desirable to provide gas handling or gas recycle means indicated generally at 124 and, typically, the gas recycle means may include a gas separation means 126 for handling and separation and recovery of the gaseous volatile constituents generated from the process and for recycling through heat exchangers regulating the gas temperature to the process inert gases to maintain a substantially oxygen free atmosphere and regulated heat flow to the bed during the process.

With these principal features of the apparatus identified, and bearing in mind that this is a schematic depiction of apparatus and not intended to show any particular structures, the process may be described in rather complete detail.

Primary coal enters the system as a primary coal feed. The coal will, for efficiency, have been prepared by washing, crushing and classifying to bring into the process coal of suitable quality, quantity and particle size. Standard pea size coal is a suitable feed for the process. The primary coal feed places a layer of coal particles which is several particles thick on the conveyor 102. The coal bed thus formed moves to the right in FIG. 1, as indicated by the arrow 128 along the conveying means. At a subsequent point, intermediate the proximal end of the conveying means and the distal end, a second layer of coal is deposited, formed of recycle coal, on top of the layer of primary coal and together they form a bilayer bed which continues to move to the right as indicated at arrow 130 through the process zone on the conveyor 102. The heaters 104 apply heat, largely in the form of radiant heat, preferably, to the top surface of the bed of coal, as depicted in FIG. 1, thus heating the top surface of the bed of coal to a predetermined temperature range sufficiently high to release volatile components from the coal. In the first heating zone indicated generally at 132 the primary coal bed on the conveyor is heated to a temperature sufficiently high to remove most of the water which may be in or residual on the coal and possibly to volatilize some of the lower boiling hydrocarbon and organic constituents of the coal which are either gaseous or light oily liquids, denominated generally as light oil. Water and light oil is removed from the coal bed and recovered by the distillate recovery means 114 and the gas is recycled through the gas recycle system 124, with appropriate separation. The distillate recovery means 114 may include a catch pan 134 and a conduit 136 of any suitable size and configuration and any convenient type of collection container 138 from which the water and light oil distillate may be removed from an outlet 139 in any convenient means. Again, these are largely schematic depictions and any conventional liquid handling equipment, as described, for example, in Perry and Chilton CHEMICAL ENGINEERS' HANDBOOK, may be used.

In the next heating zone 140, the heaters 104 apply heat, preferably largely in the form of radiant heat to one surface, in the figure on the top surface, of the coal bed. The top layer of the bed at this point is comprised of recycle coal from which the water has been substantially removed and some light oil distillate has been evaporated. In the zone 140, the light oil distillates are the major and, ideally, the sole liquid product, and are collected in the distillate recovery means 116 which may include a catch pan 142, a conduit 144, a catch container 146 with an outlet 148 all generally analogous to the distillate recovery means 114, of conventional design in the chemical process industries.

In both zones 132 and 134, one surface of the bed is hot, the top surface in FIG. 1, while one surface remains unheated, the bottom surface in FIG. 1. The distillates from the hot top surface will naturally flow by gravity downwardly and tend to be condensed on the cool bottom surface of the coal bed. In this respect, this process operates as described by K. R. Bowman in U.S. Pat. No. 3,475,279, Oct. 28, 1969, and, indeed, the same principal is involved, insofar as the heating and relative functions of the bed of coal passing through the process zone. Insofar as the handling of the coal per se, and the temperature control in the processing zone per se, the disclosure of Bowman U.S. Pat. No. 3,475,279 is incorporated herein by reference.

In the third zone 150, the surface of the coal continues to be heated, in most circumstances, although residual heat may be sufficient in certain process and apparatus conditions. In addition to heating on the one surface of the coal bed, it may be desirable to provide chilling on the other surface of the coal bed to maintain the other surface of the coal bed at a lower temperature to form a condensation surface and bed as the lower part of the coal bed. This is done by providing a chilling coil 122, or any other chilling means, for the surface of the bed. In the figure, the top surface is always heated and the bottom surface is always cooler and may be chilled; however, while this is a convenient configuration of the coal bed and would be found in most systems, the orientation of the coal bed is not critical to the practice of the invention. Typically, in carrying out the invention, heat would continue to be supplied in the third zone 150 to assure relatively complete extraction of the light oil distillates. This results in some extraction of heavy oil distillates and, if desired, may result in extraction of substantial percentages of the heavy oil distillates. The light oil distillates and heavy oil distillates collected in the third zone indicated at 150 are collected through a distillate recovery system 118 which may include a catch pan 152, conduit 154, catch container 156 and a removal means 158 analogous to the systems described respecting distillate recovery means 114 and 116, all of which are conventional liquid handling systems and known in the chemical process and petroleum refining arts.

At the end of the zone 150, the coal bed is separated into two layers approximating the primary and secondary layers formed earlier in the processing. The primary coal which, at this point, has been dehydrated and from which some of the light oil has been distilled, travels down a chute 160 to a lift 162 which, for schematic depiction only is shown as an Archimedes screw 164 connected to suitable drive means 166 which lifts the coal to a vibratory or other conveyor 168 thus recycling the primary coal, to become secondary or recycle coal, in the path shown by the arrows 170, 172 and 174 to the secondary coal feed means 110. Thus, the path of the primary coal is from the primary coal feed means 106 to the conveyor 102 which, in the schematic depiction of FIG. 1, is a vibratory conveyor driven by means 176, to the right is indicated by arrow 128 under the heaters in zone 132 and continuing to the right on the bottom and exiting at 160 and being recycled through the recycle means 108 to the secondary coal input means 110. The secondary coal travels on top of the primary coal layer through zone 140 in the direction of the arrow 130, and at the end of the zone 150 travels as indicated by arrow 178 along a separating vibratory, or other, conveyor 180 which may be driven by any suitable means 184 and then exits at the char recovery means 112. Suitable gas seals are provided at the primary coal feed means and at the char recovery means.

It is desirable to provide means for providing and maintaining a suitable gas atmosphere. Manifold line, including stem and throttle valve assemblies **124*a*, 124*b* and 124*c* collect gas from subjacent the bed in zones 132, 140 and 150, creating a pressure difference across the bed drawing gas and liquid downwardly in the particular figure. The gas is removed through conduits 186 and suitable pumping means 188 and may, in a preferred embodiment, be passed through gas separator system 126. Any of the many types of known gas separators may be used. It is desirable to provide for recovery of combustible hydrocarbon gases which may be used as a fuel or for further processing. Thus, water may be removed through a conduit 190 and hydrocarbons through a conduit 192 from a gas separator system of any known or conventional design. Some of the gas, comprising in large measure inert nitrogen is recycled, as, for example, by means of a pump 194 and a conduit 196 to an entry point indicated at 198 in the primary coal feed zone or, if desired, at any point in the gas enclosure such that, in the preferred embodiment, the gas return will be on the heated side, the top side as shown in the figure, of the coal bed. Heat may be provided by passing the gas through any desired heat exchanger, e.g. hot char from the process, a combustion chamber, or a conventional gas heat exchanger of any type, shown at 197, and the hot gas may be introduced into zones 132, 140 and 15 respectively through line 199 which is connected by means not shown to gas diffusers 199*a*, 199*b* and 199*c*. Thus, by controlling the gas temperature, the rate of recycle and the rate of pumping of the gas, a pressure differential may be maintained across the bed, vertically from top to bottom in FIG. 1**, from the top or high pressure heated side to the bottom or low pressure cooled side. Flow rates as may be desired can be controlled by controlling the pressure differential, to carry the volatiles from the hot side of the coal bed to the cold side of the coal bed where the volatiles are condensed to become the various liquid distillate products. This concept, broadly, of causing a gas flow to occur through a coal bed heated on one surface and maintained in a cool configuration on the other surface, was first developed by Clyde H. O. Berg as an improvement by Berg to the Bowman process upon which Berg was then working and is described in U.S. Pat. No. 3,432,397, Mar. 11, 1969, the disclosure of which is incorporated herein by reference.

Gas flow through a bed of carbonaceous material is also disclosed, albeit in a different process and different context, in Haddad, et. al., U.S. Pat. No. 3,483,115; Knight, U.S. Pat. No. 4,058,905; and Knight, et. al., U.S. Pat. No. 4,082,645.

The various apparatus and processes for handling solid, liquid and gaseous materials, separate from the inventive process, are those known in the chemical process industries and in petroleum technology. Reference is made to Hobson, G. D., MODERN PETROLEUM TECHNOLOGY, 4th Edition, Applied Science Publishers, Ltd., Great Britain, 1973 and Perry and Chilton, CHEMICAL ENGINEERS' HANDBOOK, 5th Edition, McGraw Hill, New York, 1973, and to the petroleum and chemical processing industry literature generally for detailed descriptions on the various apparatus and processing structures and conditions.

Figure 2:
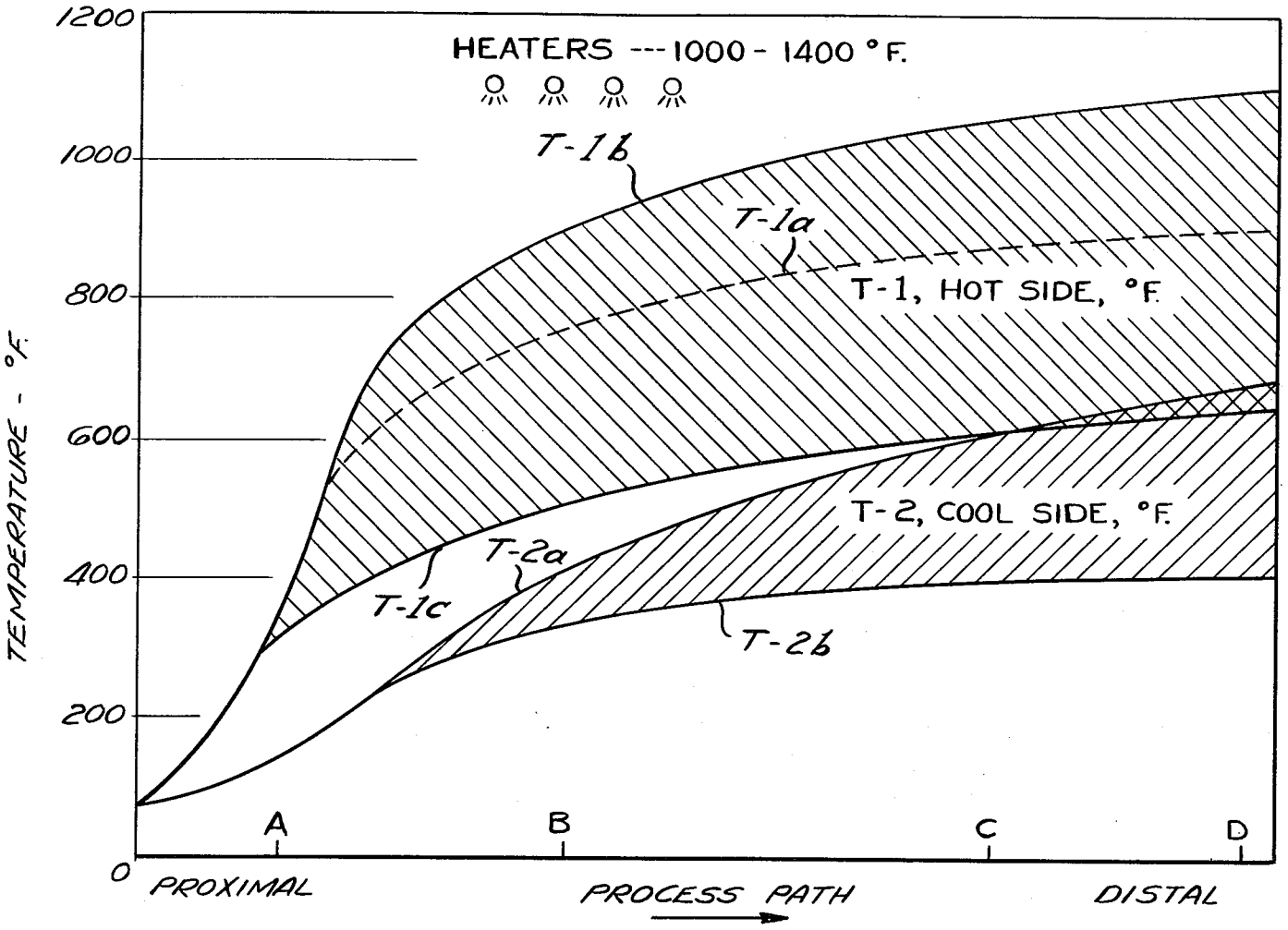
FIG. 2 is a graph showing the temperature of the bed at various stages along the process path from the proximal or starting end of the process path to the distil or finishing end of the process path.

FIG. 2 shows graphically the general temperature-path position relationships which are preferred in the process of the present invention. The heaters generally operate in a temperature range of from about 1000° to 1400° F., simply because this is a convenient operating range for most heaters, including Calrod heaters, and provides efficient heating, largely or solely by radiant heating, of the top surface or hot side of the bed during processing. It will be understood, however, that the actual operating temperature of the heaters is of virtually no consequence so long as sufficient heat reaches the top surface of the bed of coal. Obviously, considerations of efficiency of radiation, distance from the bed, other heat transfer mechanisms, etc., come into play in the design and selection of particular heating means. Thus, the heating means of this invention need only be capable of providing the hot side temperatures in the bed.

It is convenient to consider the process as occurring in three stages, although it will be understood that these stages may be broken up into any number of substages or combined, as may be most convenient for the collection of the distillate. Indeed, the entire distillate product could be collected in one container and separated by fractional distillation or other conventional means used in the petrochemical industry. It is more convenient, however, to consider a first phase as primarily functioning to collect water and some, preferably small, amount of light oil distillate followed by a second stage in which the bulk of the light oil distillate, which usually is the economically most valuable product fraction, is collected, followed by a third stage in which primarily heavy oil distillate, with some residual light oil distillate in most cases, is collected. The zone A–B in FIG. 2 depicts generally the range of the first stage, the zone B–C depicts generally the range of the second stage, and the zone C–D depicts generally the range of the third stage. It will be realized, of course, that the length of the respective stage may be selected as desired and that the dimensional relationships between the range A–B, the range B–C, and the range C–D, in FIG. 2 have no significance whatever as compared with the actual length of the stages in the processing apparatus. The lengths shown are selected rather arbitrarily and intended generally to depict the relative volumes of constituents which are sought to be collected in the various stages. Thus, the stage B–C would collect a larger quantum of the usable distillate than would be collected in either stage A–B or C–D.

As shown by the graph of FIG. 2, the temperature range T-1 is the temperature at which the hot side or hot surface of the coal would be heated to bring about the distillation of the volatiles in the coal and the temperature T-2 would be the cool side of the coal which would be maintained at a temperature low enough to bring about significant condensation of the volatiles resulting from application of T-1 to the hot side of the coal. While the zones T-1 and T-2 may overlap, it will be understood that there will always be a differential between T-1 and T-2, i.e. T-1 will always be hotter, usually by 50° F. to 100° F. or more, than T-2. Thus, in the optimum range, for a particular coal, depicted generally by the line T-1*a* for the hot side of the bed, the temperature T-2 may be anywhere in the indicated range and, of course, the same is true if the hot side is at the maximum upper temperature range T-1*b*. In the latter case, the cool side would normally be at or near its maximum temperature range shown by the line T-2*a*. If the hot side was at or near its minimum range as indicated at T-1*c*, then the cool side of the coal would be at or near its minimum temperature range T-2*b*. In general then, the hot side of the bed will reach a maximum temperature of from about 550° F. to about 1100° F., optimally in the range of about 900° F. to maximize light oil production and minimize heavy oil production, while the cool side of the bed will reach a maximum temperature of from about 350° F. to about 700° F., none of the maximum or minimum or specific temperatures being critical, the hot side T-1 always being higher than the cold side T-2 by a temperature differential of at least about 50° F. The exact temperature ranges to be selected are discussed elsewhere in the specification; however, it will be understood that optimum temperature ranges to be selected will depend upon a number of factors within the discretion and choice of the operator. These factors include considerations such as the type and quality of the coal, the ease of distillation, the relative content of light oil distillates and heavy oil distillates, the desired product mix, relative availability of the product from the particular coal, the marketability and market price of particular cuts of the distillate, and the overall efficiency and economy of the process giving weighted consideration to the relative quantities and values of the particular cuts of the distillates which can be obtained from the particular coal. It is, therefore, not possible to state that a given set of temperature conditions T-1 and T-2 is optimum or best because what is optimum for one coal and in one circumstance may not be optimum in another circumstance for a different coal. It is, however, well within the skill of the art to work from the information given herein and to arrive through routine evaluation at an optimum set of conditions to produce a maximum value output stream for any given input coal composition.

It is well to note that near the right-hand side of FIG. 2, at the lower temperature ranges of both T-1 and T-2, there tends to be a flattening of the curve. This flattening results, of course, from natural cooling or the controlled application of chilling to the bottom of the coal bed and has a more pronounced flattening effect on the bottom temperature than upon the top temperature.

Figure 3:
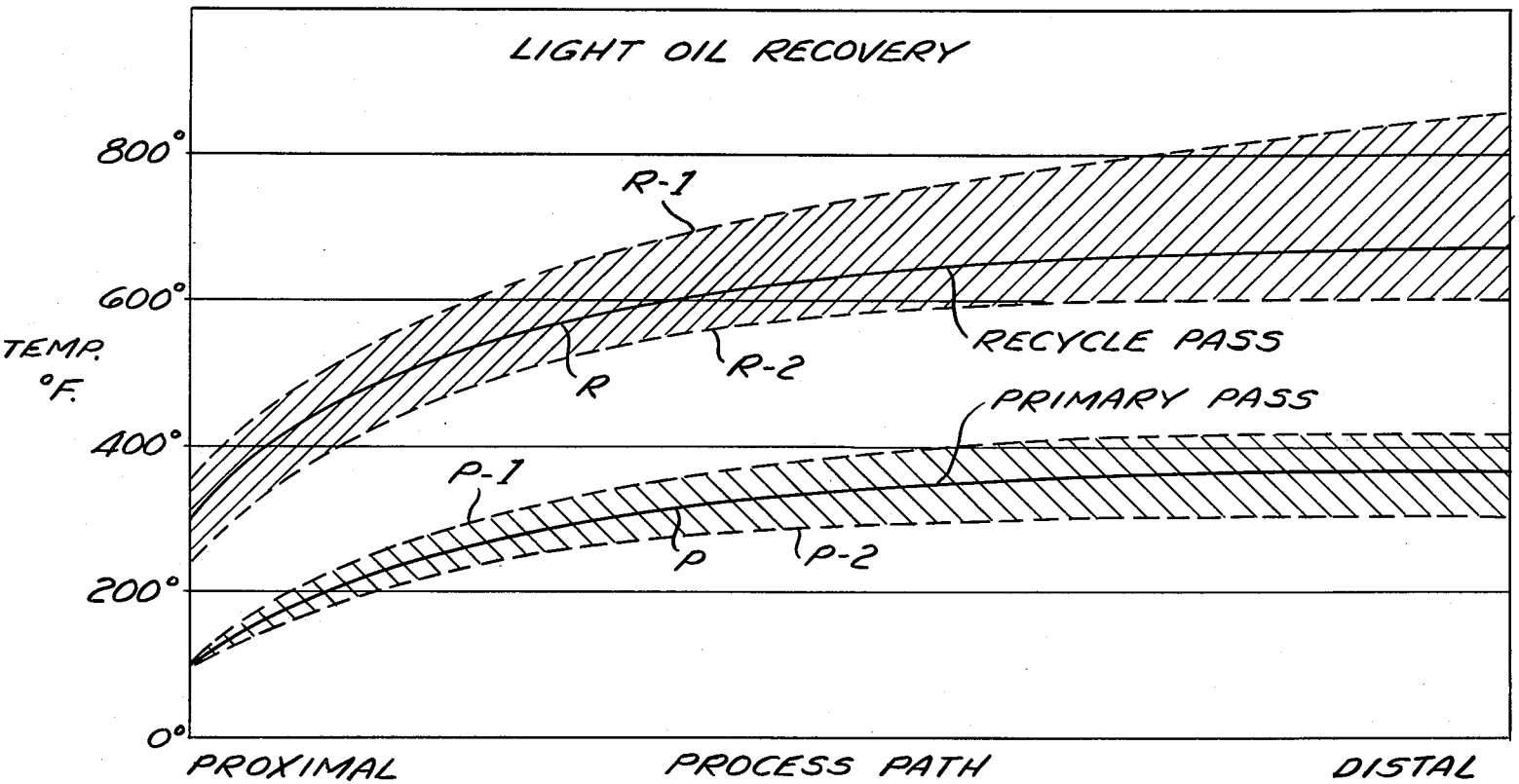
FIG. 3 is a graph showing the temperatures along the process path for the primary paths and the recycle paths.

FIG. 3 shows graphically a typical temperature-position curve for a given batch of coal as it travels through the process of the present invention. As the coal passes through the primary paths, when it is on the bottom of the bilayer of coal which is subjected to heat from one side, typically radiant heat from the top, in a typical application of the process to recover light oils, the temperature would begin at ambient and would slowly and gradually increase to a maximum temperature of from about 300° to about 450° and typically in the vicinity of just under 400° F. The gradual rise in temperature results because the primary pass of coal is shielded from the heat by the recycle pass. As the primary pass is completed and the coal is recycled, more or less of the heat is lost. In some apparatus for carrying out the process, essentially no heat is lost in the transfer from primary paths to the recycle paths. In other instances, virtually all of the heat from the primary paths could be lost, if there were a long residual time between the primary paths and the secondary paths. Indeed, the coal from the primary paths could be stored for hours or even weeks if desired, before the recycle paths were completed. For economy, however, it is desirable to transfer the coal from the primary paths to the recycle paths without undue loss of heat. Assuming only a comparatively modest loss of heat, the coal is transferred from the primary paths to the recycle paths where the temperature rises rather rapidly to a temperature of around 600° F. and then somewhat more gradually to a temperature of from about 600° to about 850° F.

In the preceding example, it should be noted that the process is designed to recover light and middle fraction oils with minimal recovery of heavier oils. In the preferred embodiment of this particular application of the process, the temperature line P for the primary paths and the temperature line R for the recycle paths would typify a process carried out for the recovery of hydrocarbons and other volatile constituents from coal having a maximum boiling point of about 400° F. to 425° F. If lighter oil were desired with additional exclusion of heavier oils, then a temperature more corresponding to temperature line P-2 for the primary paths and temperature line R-2 for the recycle paths would be adopted. Conversely, if one chose more complete recovery of the middle fractions of the volatiles from the coal with boiling points up to 450°, for example, with some recovery of heavier fractions, then a temperature path P-1 in the primary paths and a temperature path R-1 in the recycle paths would be adopted. It will be understood, of course, that these are merely examples to point out the broad application of the process of this invention and are not limiting to the particular temperatures or temperature ranges indicated in FIG. 3, particularly, when considering that, if desired, the complete devolatilization, of the recycle coal is also possible by the process.

Figure 4:
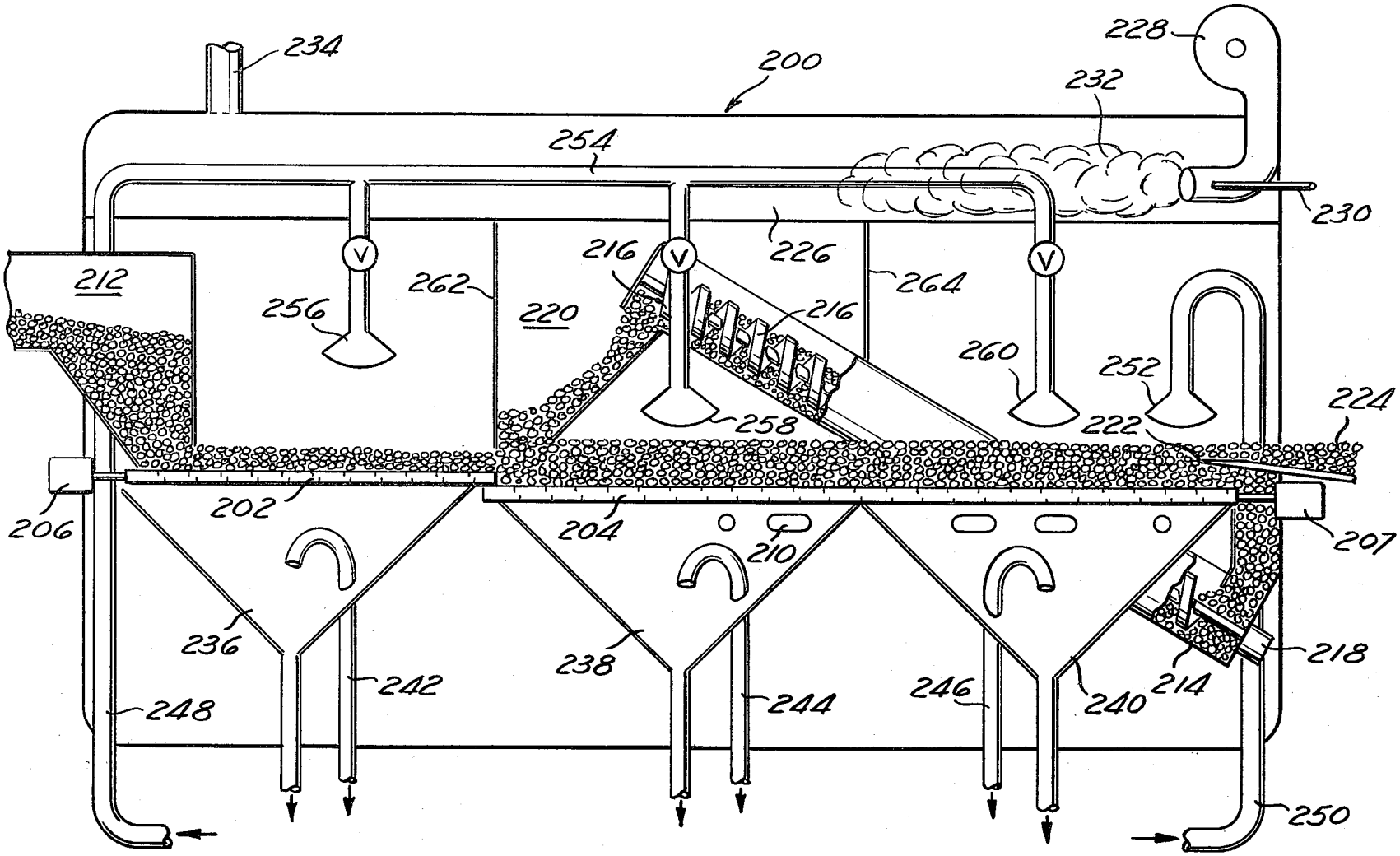
FIG. 4 is a side view schematically depicting an alternative embodiment of an apparatus and depicting an alternative method for carrying out the invention.

FIG. 4 is a schematic depiction of an alternative embodiment of an apparatus for carrying out the process in which a fluid fuel combustion chamber is used to provide the radiant heat. The apparatus of FIG. 4, indicated generally at 200, includes tandem foraminous vibratory plates 202 and 204 connected, respectively, to drives 206 and 207 to propel the coal to the right, as shown in FIG. 4, through the zone in which the processing occurs. Cooling is provided by coils 210 near the distal end of the process path.

Coal enters the primary coal input 212 where it is laid down in a relatively uniform depth bed on the conveyor 202 whereupon it is propelled to the right. This layer of primary coal, whose temperature would follow the path generally indicated at P for the primary paths in FIG. 3, travels to the right, is transferred to the conveyor 204 and is taken off separate from the secondary coal, in a coal recycle means 214 which includes an Archimedes' screw 216 and appropriate drive means 218 to convey the primary coal, now secondary or recycle coal, to the secondary coal feed means 220 where it is applied on top of the primary coal layer to form the recycle coal layer which is subjected to the process heat. The entire bed of coal, the bilayer comprising the primary layer of green coal from feed means 212 and the secondary layer or recycle coal from feed means 220, is propelled to the right by the conveyors 202 and 204 to the splitter 222 which separates the secondary layer from the primary layer, the secondary layer being removed as char by the removal means 224. Radiant heat is applied from a combustion chamber 226 spaced above the coal bed which is heated by any suitable combustion apparatus, a blower 228 and a fluid feed conduit 230 which, combined, results in a flame 232 with combustion gases being removed at 234 being indicated as exemplary of the type of heating which can conveniently be provided. The fuel entering at line 230 is mixed with air from the blower 228 to provide a highly efficient combustion mixture. The fuel may be any fluid combustible material including one or more of the volatiles removed from the coal, or even slurried coal or char particles carried in water, methanol hydrocarbon, or other liquid. The technology for liquid fueled burners is well developed and temperature controlled and distribution of heat is easily accomplished using technology common in the furnace industry, the principles of which are discussed in Perry and Chilton, supra, incorporated herein by reference. As previously indicated, the exact source of heat is of no consequence in this invention, so long as adequate heat at the desired temperature range is available, the foregoing apparatus merely exemplifying and not limiting the types of heat which may be used.

The fractions of distillate from the coal are collected in the catch pans 236, 238 and 240, comparable to the catch pans previously described and gas may be recycled from any suitable means through conduits 242, 244 and 246 back into the enclosure vessel, through suitable valves, manifolds, pumps, any gas handling equipment, and line 248, all as described with respect to the first embodiment.

The fractions of the distillate from the coal are collected in the catch pans 236, 238 and 240, the type previously described, as the distillate flows by gravity aided by a pressure differential across the bed into the catch pans and into suitable collecting vessels, as previously described. Gas is collected at any desired number and distribution of gas recovery points, three of which are shown with the gas passing through a manifolding arrangement to conduit and into a gas treatment system. Recovered gas is withdrawn from the gas processing system through a conduit, as desired and previously described, and water recovered from the system is withdrawn as previously described.

Any desired portion of the gas, as necessary to provide a substantially oxygen free atmosphere and to provide heat flow through the gas as desired, is pumped via any convenient gas pump, such as a roots blower, or any of the conventional gas pumping means, see Perry and Chilton, supra, through a suitable conduit system, one portion of which if desired, may be pumped directly, without further processing or handling, into the space above the bed. Additional heating may, of course, be provided, as will be described below. It is, in some processes, highly desirable to provide gas at a cooler temperature than the temperature of the surface of the coal near the end of the process path for controlling the rate of distillation and the products being distilled from the coal. This is indicated generally by the positioning of a gas line 250 and distributor 252 into the space above the coal. The gas may also be heated by, for example, manifolding it through a heat exchange tube 254 and returning the hot gas through distributor means 256, 258, and 260 which may be in any configuration or form and, conveniently, or simply tubes with side slots or openings for directing the gas onto the surface of the coal. Any number of manifolds can be provided and any number of input distributors to the space above the bed. If desired, the secondary layer of coal may be subjected to preliminary heating before the first layer of coal is placed thereon by gas distributor 256 which distributes the hot gas only above the primary layer of coal before the secondary, recycle coal, layer is added. In the embodiment as shown in FIG. 4, a high pressure zone is provided in the high temperature part of the processing zone, above the bed, and a low temperature zone is provided below the bed in the processing zone, causing the gas to flow downwardly from the hot side to the cold side of the coal, carrying the distillate with it, in aid of gravity removal, and forcing the distilled condensable vapors into contact with the lower, cold layer of coal. Baffles 262 and 264 divide the process zone into three portions for separate temperature and pressure control. The rate of heat transfer through the bed can be finely tuned to provide the desired temperature gradient through the bed, by simply controlling the temperature input of the gas and the rate of the gas flow.

Many control devices which are conventional and standard in chemical processing have been omitted for clarity of illustrating and describing the invention. Thermocouples, thermistors, coupled with suitable servo circuits, bridge circuits, and heater controllers, are readily available and conveniently used for controlling the temperature of the Calrod heaters, the temperature of the flame in the boiler box, the temperature of the gas input to the process, the temperature of the gas in the processing system and temperature of the return gas to the system, as well as any other temperatures which may desirably be controlled. It is convenient, for example, simply to sense the temperature of the few particles which form the upper surface of the bed and the few particles which form the lower surface of the bed. This, of course, gives a mean or average temperature reading which does not represent either the minimum temperature of the upper half of the bed or the maximum temperature of the upper half of the bed nor, with the lower sensor, the maximum or minimum temperature of the lower part of the bed, but does provide a suitable control signal. The temperatures measured will roughly correlate to the boiling points of the liquids sought to be collected, except that the temperatures measured will be somewhat higher than the boiling point of the liquids which are distilled in large quantities from the coal. Where, for example, it is desired to collect a liquid fraction which has a boiling point range of from around 225° F. to around 400° F., then the lowermost sensing point in the primary bed of green coal should measure a temperature of no greater than about 400°, and preferably in the vicinity of 225° to 400° F. The liquid thus collected would then have a weighted boiling point average of between 225° and 400° F., usually in the range of around 275° to 325° F. The weighted average of the boiling would, as in ordinary calculations, be the sum of the boiling point temperature times the weight fraction of the constituent. Thus, a mixture of 60% of a liquid boiling at 260° F. and 40% liquid boiling at 325° F. constituting the other 40%, by weight, would be 260 times 0.6 plus 325 times 0.4 or 286° F. Control valves, gas flow and fuel flow controllers, etc., all as well known in the art are readily within the skill of the art and would be used in the routine construction of apparatus of the type generally described.

It is appropriate here to point out that one of the great advantages of this invention is that there is little heat lost in the process, except that which is carried out with the char removal and a limited amount of heat which goes out with the liquid recovery, because the heat of evaporation is regained by condensation and is recycled via the gas processing system and is therefore conserved.

FIGS. 5, 6 and 7 depict schematically another apparatus which is particularly well suited for carrying out the process of this invention. In terms of process efficiency, continuous conveyor belts of a foraminous material, for example a wire screen, are highly satisfactory for carrying out the process described in this invention, and apparatus using this type of conveyor is quite adequate and performs quite satisfactorily.

Notwithstanding the satisfactory process performance of the foraminous continuous belt type conveyor, there is a tendency of the belt to wear out rather rapidly because of the abrasive nature of the coal and the inclusion of coal particles and particles of harder materials, silicates, crushed rock, etc., which may be included in the coal in minor amounts. The apparatus depicted in FIGS. 5, 6 and 7 solves the wear problems inherent in using a continuous foraminous conveyor belt by eliminating the belt and replacing it, effectively, with a heavy duty annular foraminous support disc which can be made as heavy as desired and designed to have a virtually unlimited use life. The life of this type of device is increased because of two principal factors. First, there is no relative movement between the elements of the supporting conveyor substrate, as is the case with a foraminous conveyor belt. Rather, the present embodiment of the invention includes a solid perforated annular disc. The second advantage is that the disc can be made of substantial thickness since it need not flex, an advantage not available with the foraminous continuous conveyor belt.

FIG. 5 is a highly schematic depiction of the apparatus showing the relative location of the major components of the apparatus but omitting structural details for clarity. This embodiment of the invention comprises an annular disc 300, the details of which will be described hereinafter and which are omitted from FIG. 5 for clarity. Briefly, however, the disc 300 is a heavy duty circular steel plate with holes formed therethrough to permit passage through the plate of condensed volatile distillates, according to the process of this invention. The disc may be annular, i.e., having a hollow center, and that is its preferred embodiment, but it may simply be a circular disc in which the area used for carrying out the process is generally in the configuration of an annulus. Coal feed means indicated generally at 320, char recovery means indicated generally at 340 and coal recycle means indicated generally at 360 are provided. In addition, suitable catch pans 380, 382, and 384 and cooling coils 386 are provided according to the invention as previously described.

The coal feed means may include any means for transferring green coal into the process and feeding it onto the conveying means 300. In the particular embodiment depicted, a conventional conveyor belt 322 supported by a conventional conveyor belt roller 324 carries coal to the point indicated at 326 where it is dropped on a vibratory conveyor plate 328 which carries the coal to a drop feed bin 330, a side view of which is best shown in FIG. 6. Char is removed from the apparatus by a conventional conveyor belt 342 carried on a conventional conveyor belt roller 344, the coal being dropped on the conveyor belt 342 from a vibratory conveyor plate 346, the edge of the conveyor plate 348, shown in FIG. 6, forms a splitter which separates the upper, or completely recycled coal layer, from the lower layer of coal which originated as the primary layer and will then be recycled. The operation of the vibratory conveyor and splitter is as generally known and described in, for example, Perry and Chilton, supra.

The recycled conveyor 360 is a conventional vibratory plate conveyor in which the lower edge 362 rides adjacent to the surface of the conveying means 300 and picks up the coal which was previously the primary input to the system and conveys it in the direction shown by the arrow 364 upwardly and drops it into a feed bend 366 from which it is fed as a second layer on top of the coal coming from the feed means 330. The side view shown in FIG. 6, with the addition of a depiction of coal being carried according to the process of the invention and the operation of the apparatus, depicts one relative spacing of the various components of the apparatus for conveying the primary coal onto the conveying means recycling the primary coal as recycle coal and removing the char from the process and the apparatus. Other spacings may be used, the spacings being depicted in FIG. 6 shown merely to exemplify the invention.

Details of construction of an apparatus of the type depicted in FIGS. 5 and 6, adequate for those skilled in the art to make and use the invention, based upon standard engineering principles as set forth in STANDARD HANDBOOKS, Perry and Chilton, supra, for example, is shown in FIG. 7. The entire apparatus in FIG. 7 is supported by a plurality of support members shown generally at 398, typical of those used around the apparatus. The support members 398 may be angle iron, I-beams, trusses, steel or concrete posts, or any other suitable support means.

The conveyor means 300 is an annular plate and, in the preferred embodiment, is provided with pairs of upstanding annular flanges 302 and 304 and flanges **302*a* and 304*a* providing a space therebetween which may be partially filled with a liquid 306 and 306*a* to provide a liquid seal between the conveyor means and upper lip portions 308 and 308***a* of the upper, reflective surfaced containment vessel for the entire apparatus. Similarly, flanges 310 and 310*a* extend downwardly into a liquid contained in annular troughs 311 and 311*a* formed on or integral with the lower gas containment walls 312 and 312*a* from which gas may be removed by any convenient method or means such as the conduit 313. Gas may similarly be recycled into the upper portion of the gas containment means by line 313*a*. Heat is supplied by a plurality of heaters indicated at 314 supported by suitable brackets above the conveying means. The conveying means is supported for revolving about a center axis by a plurality of rollers or supports 315 which may be mounted to the supports 398 by any suitable means such as pins 316. Some of the supports 317 may be connected by a drive shaft to drive means 318 to drive the conveying means in a revolving path about a center axis located at the center of the annular conveying means.

This embodiment of the invention is preferred in many respects because it combines simplicity of operation, long life, and efficiency of operation with a relatively inexpensive installation and very low maintenance costs. It is the process of the invention, however, which is the principle consideration, and therefore the particular apparatus in which the process is carried out is not considered to be a limiting factor on the scope of the invention.

Figure 8:
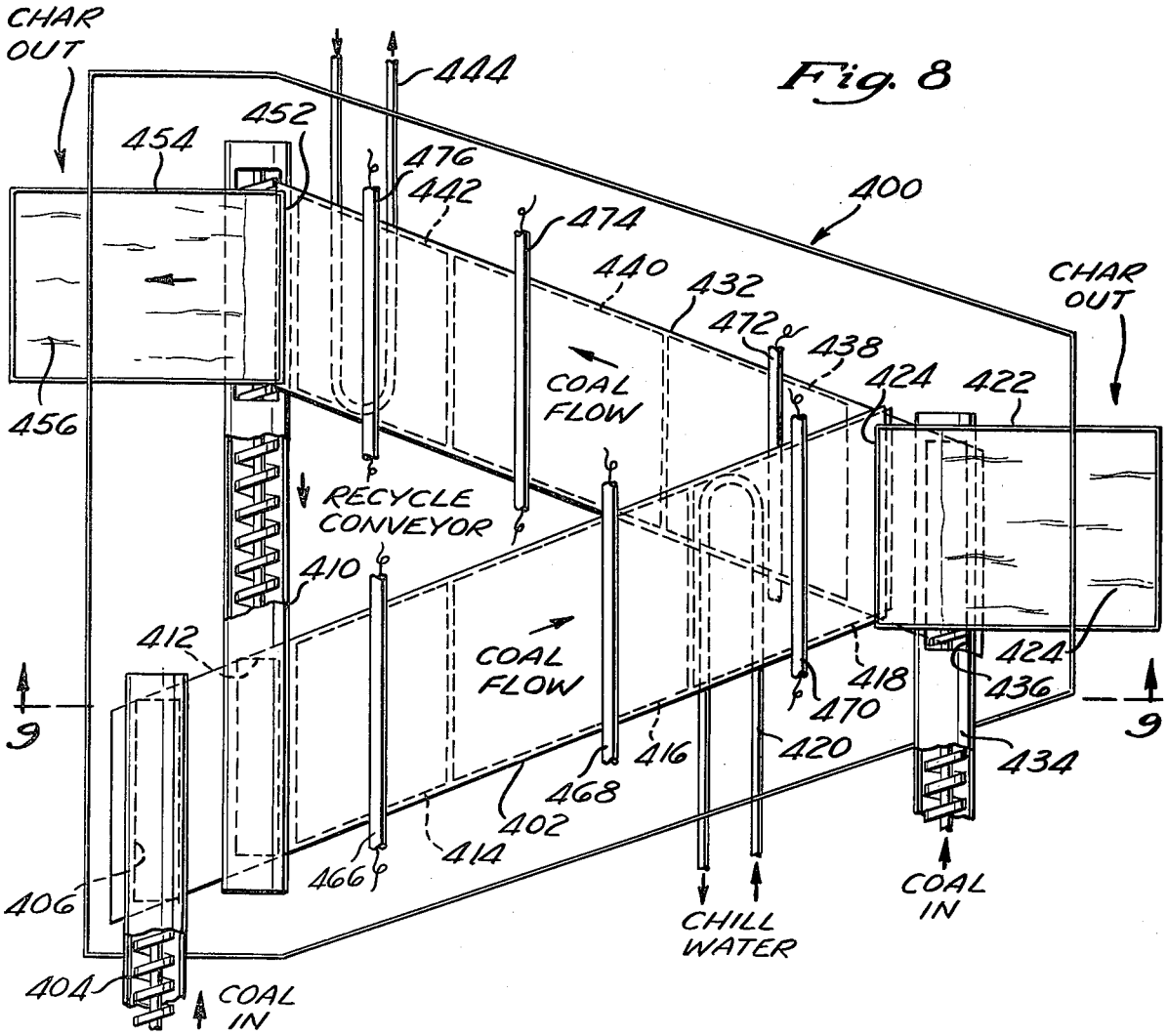
FIG. 8 is another embodiment showing a folded process path apparatus and procedure, in top plan view, with the cover of the enclosure removed for visualization.

FIGS. 8 and 9 depict, again schematically, a folded embodiment of the invention depicted in a linear embodiment in FIG. 4, with some minor modifications to accommodate to the folding of the flow path. FIG. 8 is a top plan view of the folded configuration of the apparatus of this particular embodiment of the invention. This embodiment, identified generally as apparatus 400 comprises a first conveying means 402 which, as in the other embodiments, may be a vibratory plate conveyor, a foraminous continuous conveying belt, or any other means for conveying the coal along a process path. Coal is fed from any convenient input means such as the Archimedes' screw conveyor 404 and a suitable spreading bin 406. The coal travels, viewing FIG. 9, to the right on the conveying means 402, as indicated by the arrows, and upwardly in FIG. 8, as indicated by the arrow. Secondary coal is fed from a conveyor 410 and a distributor bin 412 to form the top of the coal bilayer which travels along the conveying means 402. Distillate is collected in a plurality of catch pans 414, 416 and 418 which underlie the conveying means. Chilling is provided, if desired by a chilling coil 420. The edge of a removal bin 422, the edge being indicated at 423 forms a splitter. The entire catch pan may be vibrated if desired to provide effective splitting action. The upper layer, which has been recycled, as fed from the recycle input 410 is removed as char and dropped into the liquid indicated at 423 through which it passes and through an opening 426, through the seal formed by the liquid to an outside bin from which it may be removed by any desired means. The liquid forms a seal to prevent loss of gas from the apparatus and provides a basin or bin from which the coal char may be removed by any conventional means, such as a conventional bucket lift conveyor, for example, see Perry and Chilton, supra. The primary coal fed from the input 404 simply drops as a top layer of a bilayer of coal on conveying means 432, the primary coal forming the bottom of the bilayer, being fed from any convenient primary coal feed means 434 and spreader 436, as depicted being of the type described with respect to feed means 404 and spreader 406. The coal travels on the conveyor means 432 upwardly, as shown by the arrow, to the left as viewed in FIG. 9. The distillate is removed by a plurality of catch pans 438, 440 and 442, chilling being provided by a chilling coil 444 if desired. The catch pans 414 and 438, both receiving the lowest boiling fraction of the volatiles in the coal, mainly water and very light oils, may be combined in a conduit 446 for removal. Likewise, the light oil or middle fraction removed from catch pans 416 and 440 may be combined in a conduit 448 for removal and in like manner the higher boiling materials collected in catch pans 418 and 442 may be combined in a conduit 450 for removal. The upper completely processed layer of coal is removed by means of a splitter edge 452 on a removal bin 454 which contains a liquid seal 456, as described with respect to the removal means 422. Again, the coal may be removed from the bin 456 by any convenient means, the particular bin being designed for use with a bucket lift. The primary coal which is deposited from the feed means 434 and the bin 436 onto the conveying means 432 is simply dropped into bin 458 which directs it into the conveyor 410, which in the exemplary embodiment is a screw conveyor, from which it is conveyed to the bin 412 which deposits it as the secondary or recycled layer on the conveying means 402. The entire apparatus is contained in a gas containment vessel 460 from which gas may be removed by a conduit 462 and processed in any desired way, for example as previously described, and all or part of the gas may be recycled as desired through a gas input 464.

Heat may be provided in any desired manner, in the embodiment depicted, exemplary Calrod heaters 466, 468, and 470 provide heat to the coal on conveying means 402 while Calrod heaters 472, 474 and 476 provide heat to the coal on conveying means 432.

Figure 9:
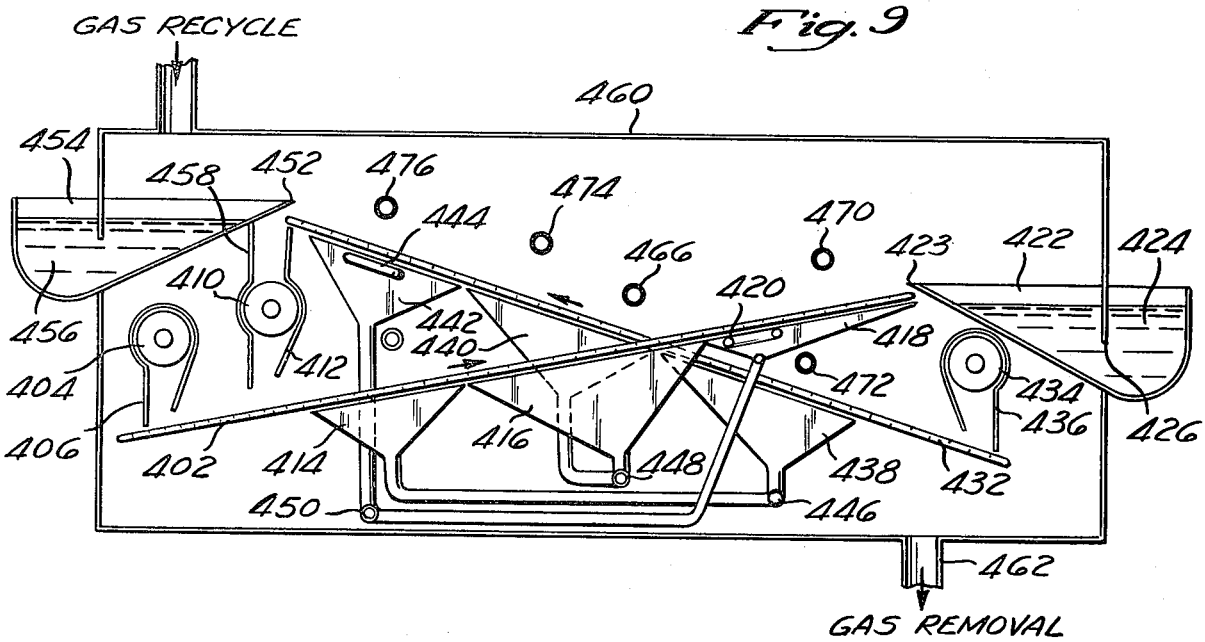
FIG. 9 is a side elevational view of the apparatus depicted in FIG. 8, with the top cover added for more clear illustration, taken substantially along lines 9—9 of FIG. 8.
Figure 10:
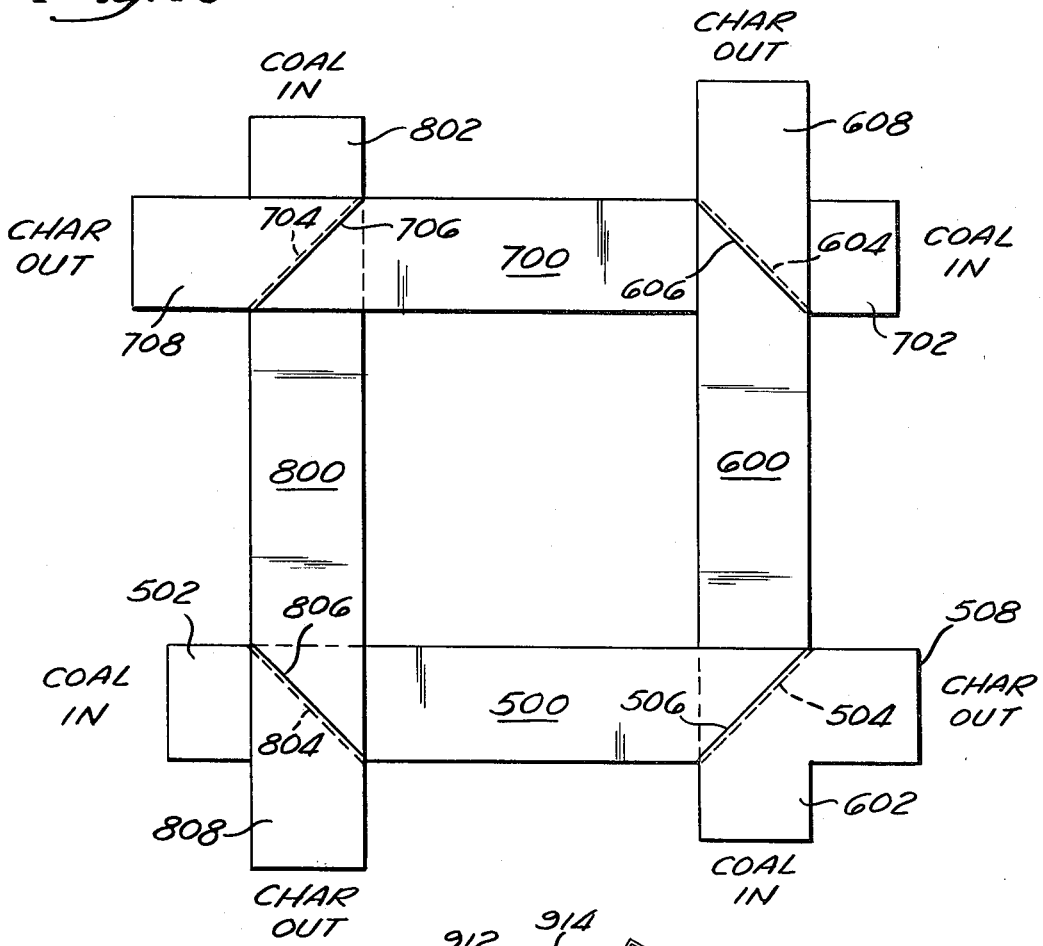
FIG. 10 is a schematic view of a multiple folded tandem apparatus in which four processing zones are operated in tandem with each other, the showing being schematic and diagramic to show the relative positions of the processing zones and conveyors, without structural details.

The principal of the folded apparatus depicted in FIG. 8 and FIG. 9 can be applied to a multifolded apparatus, using three, four or more folds. A schematic layout of a four-folded apparatus of this type is shown in FIG. 10. The first conveying means 500 is adapted to receive coal from any desired input at one end 502 and convey it, as by a vibratory plate, to a beveled edge 504 at the other end from whence the lower portion of the coal drops onto the conveying means 600, on top of primary coal fed previously to the conveying means 600 at a point 602, by any convenient means. In like manner, the coal is conveyed along conveying means 602 to beveled edge 604 from whence the coal drops onto a previously formed layer of primary coal on conveyor 700, the primary coal having been formed as a layer at 702. The coal travels to the edge 704 from whence it drops onto a layer of primary coal on conveying means 800, the primary layer of coal having been formed at 802, by any conventional primary coal feed means. The coal on conveyor 800 travels to the beveled edge 804 from whence it drops onto the primary coal formed at 502 on conveyor 500. Char is removed by a vibratory splitter 506 at the removal means 508 from conveying means 508, from the splitter edge 606 to the removal means 608 from the conveying means 600, from the splitter 706 to the removal means 708 from the conveying means 700 and from the splitter 806 to the removal means 808 from the conveyor means 800. Thus, in this particular embodiment, there are four primary coal inputs and four char removals, the primary coal of each station becoming the secondary coal of the next succeeding station, in a cyclic pattern. In this particular example, four conveying means are connected in a complete closed cycle but the number of conveying means may be from three to any desired number and the folds may be relatively simple as indicated in FIG. 10 or highly complex. The feature of this invention which is of great importance is the provision of a plurality of conveying means, each provided with means for removing the fully processed coal char, and for conveying the primary coal from the conveying means to a second conveying means where it becomes a secondary layer on a primary layer of coal on the next conveying means and, likewise, removing the fully processed coal char from the next conveying means and depositing the primary coal as a secondary layer on the next following conveying means, etc. as many times as may be desired in planning the configuration.

Figure 11:
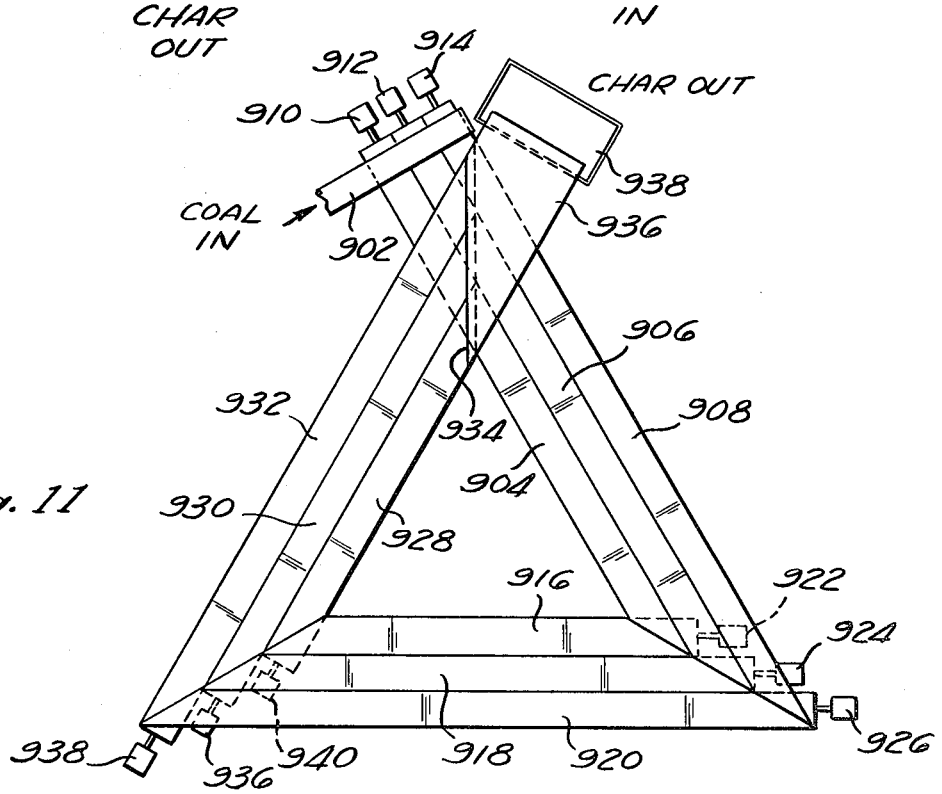
FIG. 11 is a schematic plan view of the general layout of a triangular folded process apparatus and method in which multiple parallel processing paths are operated to give substantially identical residence times in the processing zones by causing the coal to travel through the processing zones at relatively different velocities.

Additional compactness can be accomplished using an apparatus of the type depicted in exemplary embodiment FIG. 11. In this embodiment, the path is triangular but it will be readily understood from the following description that the path could be square, rectangular, pentagular, in the form of a hexagon, etc.

In FIG. 11, coal is fed from any convenient primary coal source into a coal feed means 902 which feeds three parallel processing paths on parallel conveying means, vibratory plate conveyors being depicted schematically, but any other conveyor being suitable. The three conveying means 904, 906 and 908 are independently driven, or at least driven in a manner in which the relative motion can be varied with respect to one another, by drive means 910, 912, 914, respectively. The construction and driving of this type of conveyor is well known, see Perry and Chilton, supra, for example. The coal from conveying means 904 is deposited on conveying means 916, the coal from conveying means 906 is deposited on conveying means 918, and the coal from conveying means 908 is deposited on conveying means 920, these conveying means being driven respectively by drives 922, 924 and 926. Likewise, the coal from conveying means 916 is dropped on a conveying means 928, the coal from conveying means 918 is dropped on conveying means 930, and the coal from conveying means 920 is dropped on conveying means 932, these conveying means being driven respectively by 934, 936 and 938. A splitter edge 934 on a vibratory splitting and conveying plate 936 removes the top, fully processed char layer from the conveying means 928, 930 and 932 and deposits the char in any suitable receptacle 938. The receptacle may be removed periodically and replaced with an empty receptacle or the coal char may be removed from the receptacle by any conventional solids conveying means. The remaining bottom layer of coal of the bilayer which has been conveyed around the three paths 904, 916, 928, and 906, 918, 930, and 908, 920, 932, are dropped, respectively, as the second, recycle layer of coal on top of the primary layer on the conveyors 904, 906 and 908.

In the embodiment of FIG. 11, the conveyors may be in virtually any desired form but, preferably, are in the form of parallel longitudinally movable plates, an exemplary depiction of which is shown in FIG. 12. In addition, the enclosure 901 and dividers 903, 905, 907 and 909, between the conveying means 904, 906, 908, and a catch pan 911 with suitable points of removal for gas and liquid are shown to illustrate the general arrangement of the conveying means of the embodiment of FIG. 11. Heat is provided by a conventional heating means such as a Calrod 913, or in any other desired manner.

It will be understood, of course, that while three paths have been shown, two, three, four, or any larger number of paths may be constructed in parallel. There are no technical limitations on the number of paths, the only constraints being to optimize the cost of the installation versus the relative advantages of multiple paths. The multiple path concept of the apparatus depicted schematically in FIG. 11 and with some greater detail in FIG. 12, one may compact the space requirements for the apparatus. The residence time of the coal in the process may be maintained relatively constant even though the rate of travel through the process zone will vary. For example, coal in the outer paths of the apparatus will travel at a more rapid rate than the coals on the inner paths to provide a residence time in the processing zone which is substantially the same for all of the paths. The number of paths will, normally, be selected to optimize the rate of travel and residence time so that from the inner edge of a given path to the outer edge of a given path there is not sufficient difference in residence time to effect significantly the amount of volatiles extracted from coal in these respective portions of a given path, or conversly, the different residence times may be used to obtain the desirable liquid fractions differentially.

For convenience, primarily, and because of a preference in many apparatus, vibratory plate conveyors have been shown primarily in the preceding apparatus. It is to be clearly understood, however, that there is absolutely no criticality to the use of vibratory plate conveyors and that any means which will convey a bed of coal along the path through a processing zone may be used in this invention. Continuous foraminous conveyor belts are regarded as a full and complete equivalent and identical to the conveying means of this apparatus insofar as the process is concerned.

In addition, while Calrod heating is indicated as a preferred mode of heating the coal, and radiant heating is indicated as a preferred type of heat, and while the heat is generally applied to the top of a bed of coal which is relatively thin compared to the width of the bed which moves through the processing zone, it is to be understood that any source of heating may be used, that it is not necessary to use radiant heat, while radiant heat is desired, and that the bed of coal may be in any orientation or configuration. For example, the process can be carried out by forming a flat bed of coal relatively thin in one dimension and relatively wide in another dimension and passing the coal through a rectangular cross-section conduit having the same dimensions as the coal bed in applying heat on one surface through the walls of the conduit and extracting heat through a foraminous wall on the other side of the thin dimension of the conduit, as depicted, for example, in FIG. 13 in which a bilayer of coal is vertically oriented between a barrier which, in this particular embodiment, is a solid sheet barrier but which may also be foraminous if desired, and a foraminous barrier 1002, the primary coal being adjacent the barrier 1002, heat being applied through the barrier 1000 with liquid distillate being removed along with gas through the barrier 1002. In this embodiment, the bilayer of coal moves downwardly between these two barrier layers, being formed by feeding recycle coal adjacent the barrier 1000 and feeding primary coal adjacent the barrier 1002, or by any other convenient means. With the char and recycle coal being removed at the bottom by any convenient splitter indicated generally at 1004.

In summary, a method of recovering liquid product by distillation of volatile matter has been disclosed which comprises the steps of forming a bilayer of coal, the bilayer comprising a layer of recycle coal on a layer of green coal, heating one side, the recycle side, of the coal bed to a temperature sufficient to volatilize at least a fraction of the coal constituents, typically those having a boiling point of between about 400° F. and about 800° F., but varying in commonly used applications, 100° lower and 200° higher than this, depending upon the desired liquid product. Meanwhile, the other side, the green side, the bed is maintained at a temperature sufficient to condense at least a fraction of these volatilized constituents, this temperature usually being in the range of 300° to 450°, and more commonly in the range of 350° to 400° F. for preferential collection of light oil fractions. The light oil fractions are collected by permitting them to pass from the cold side of the bed. The bed is separated into char product, resulting from the recycle layer, and the primary layer which entered as green coal and is now returned to the process as recycle coal, to form the high temperature side of a new bed of coal formed as described, along with input green coal as primary feed to form the low temperature side of the bed, all as described. The process is preferably, and economically, carried out as a continuous process in which all of the foregoing steps are repeated with the continuous infeed of green coal to form the primary bed, continuous recycle of the coal from the primary layer to the recycle layer of the coal bed, continuous extraction of char as product and the continuous removal of liquid product from the processing zone. No minimum or maximum temperatures are critical, but generally speaking, the cold side of the bed will operate at least as high as approximately 300° F. and the hot side of the bed will usually not operate at a temperature higher than about 1100° to 1200° F. These temperatures are the mean temperatures of that layer of coal which is most closely adjacent the respective sides of the bed.

In the presently preferred and most likely the most commonly used application of the method, the bed is controlled so that approximately one-half of the bed comprises a high temperature side at a temperature sufficient to volatilize constituents having a boiling point of from about 400° F. to about 800° F., with the other side of the bed, approximately one-half thereof, comprising the low temperature side at a temperature sufficient to condense at least a fraction of these coal constituents to a liquid. In general, the bed is formed on a horizontal foraminous conveyor, but need not be so formed, and can be formed in another orientation on another conveyor. Heat is generally provided by radiant heating means but this is not necessary and heat can be provided by direct conduction. Apparatus for carrying out the process are also disclosed having single, multiple tandem, or multiple parallel conveyors for carrying the coal bed through the processing zone, means for feeding coal to the processing zone, recovering char from the processing zone, and recycling coal to the front of the same or a different processing zone, and means for removing the liquid product.

In all of the foregoing embodiments, specific examples, structures, configurations, parameters and values have been given to exemplify the invention but it is to be clearly understood that these specific disclosures are solely for the purpose of exemplification and not for limitation of the scope of the invention, which is defined solely by the scope of the subtended claims.

What is claimed is:

1. The process for recovering liquid fuel from coal comprising continuously forming a bilayer coal bed on a foraminous conveyor, passing the coal bed through a substantially oxygen free processing zone, heating the bed in said zone to a temperature of higher than about 550° F., while maintaining the bottom of the bed at a temperature of not higher than about 450° F., removing the top of the coal bed bilayer from the processing zone as product char, recycling the bottom of the coal bed bilayer to the processing zone to form the top of a coal bed bilayer in another pass through the processing zone, and removing liquid through the foraminous conveyor as product liquid fuel.

2. The process of claim 1 wherein the process is carried out continuously by continuous removal of char and liquid product, continuous recycle of the botton of the bed to the top of the bed and continuous feeding green coal as the bottom of the coal bilayer bed.

3. The process of claim 2 further including the step of passing substantially oxygen free gas downwardly through the bed to carry volatile materials released from the top of the bed through the bottom of the bed for condensing at least some of said volatile materials on the coal forming the bottom of the bed.

4. The process of claim 1 further comprising the steps of maintaining a gas pressure differential through the bed, the high temperature side being maintained at a higher pressure than the low temperature side of the bed, thereby causing gas to flow from the high temperature side of the bed through the bed to the low temperature side of the bed for carrying volatilized constituents of coal into contact with the low temperature side of the bed for condensing at least some of said volatilized constituents.

5. The process of claim 4 wherein forming of the bed comprises placing a layer of primary green coal on a horizontal foraminous conveyor surface, and placing a layer of recycle coal on top of the green coal.

6. The process of claim 5 wherein the heating of the bed comprises directing radiant heat to the upper surface of said bed of coal to thereby preferentially heat the recycle coal without directly heating the green coal, the green coal being maintained at the lower temperature.

7. The process of claim 1 further comprising the steps of controlling the heating of the one side of the bed such that approximately one-half the bed comprises a high temperature side of the bed at a maximum temperature of greater than 550° F. and the other approximately one-half the bed comprises a low temperature side of the bed at a temperature less than 450° F.

8. The process of claim 7 wherein forming the coal bed comprises placing a layer of primary green coal on a horizontal foraminous conveyer surface, and placing a layer of recycle coal on top of the green coal.

9. The process of claim 8 wherein the heating of the bed comprises directing radiant heat to an upper surface of said bed of coal to thereby preferentially heat the recycle coal without directly heating the green coal, the green coal being maintained at the lower temperature.

10. The process of claim 9 wherein the maintaining of the other side of the bed at said lower temperature comprises the step of cooling the other, green coal side of the bed.

11. The process of claim 10 wherein the lower temperature is from about 300° F. to about 400° F. and the higher temperature is from about 550° F. to about 1000° F.

12. The process of claim 10 further comprising the steps of removing gas from the process, recovering at least some gaseous constituents from the gas removed, and recycling at least a portion of said gas as a substantially oxygen free process cover gas.

13. The process of claim 12 comprising the steps of collecting the product liquid fuel in at least two fractions including a fraction having boiling points of from about 225° F. to about 425° F. and a fraction having boiling points of higher than about 425° F.

14. The process of claim 1 wherein forming of the bed comprises placing a layer of primary green coal on a horizontal foraminous conveyor surface, and placing a layer of recycle coal on top of the green coal.

15. The process of claim 14 wherein the heating of the bed comprises directing radiant heat to the upper surface of said bed of coal to thereby preferentially heat the recycle coal without directly heating the green coal, the green coal being maintained at the lower temperature.

16. The process of claim 15 comprising the steps of collecting the product liquid fuel in at least two fractions including a fraction having a weighted average boiling point of from about 225° F. to about 425° F. and a fraction having a weighted average boiling point of higher than about 425° F.

* * * * *